US006368148B1

(12) United States Patent
Fogg et al.

(10) Patent No.: US 6,368,148 B1
(45) **Date of Patent: *Apr. 9, 2002**

(54) RIBBON CABLE CONNECTOR WITH GROUND BUS

(75) Inventors: Michael Warren Fogg; Mai-Loan Thi Tran, both of Harriburg; Benjamin Howard Mosser, III, Middletown; Robert Correll, Jr., Harrisburg, all of PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/483,027

(22) Filed: Jan. 13, 2000

Related U.S. Application Data

(63) Continuation of application No. 08/866,505, filed on May 30, 1997, now Pat. No. 6,033,238.

(51) Int. Cl.[7] ..... H01R 12/24
(52) U.S. Cl. ..... 439/497; 439/405
(58) Field of Search ..... 439/497, 499, 439/492, 108, 494, 404, 405

(56) References Cited

U.S. PATENT DOCUMENTS 4,027,941 A * 6/1977 Narozny ..... 439/402
4,068,912 A * 1/1978 Hudson, Jr. et al. ..... 439/405
4,094,564 A * 6/1978 Cacolici ..... 439/497
4,095,862 A 6/1978 Hatch ..... 339/14 R
4,140,360 A * 2/1979 Huber ..... 439/492
4,181,384 A * 1/1980 Dola et al. ..... 439/492
4,641,904 A * 2/1987 Kosugi et al. ..... 439/492
5,338,221 A * 8/1994 Bowen et al. ..... 439/405
5,893,773 A * 4/1999 Dellinger ..... 439/404
5,902,147 A * 5/1999 Jochen et al. ..... 439/497
6,033,238 A * 3/2000 Fogg et al. ..... 439/108
6,077,105 A 6/2000 Jochen et al. ..... 439/497

* cited by examiner

*Primary Examiner*—Gary Paumen
*Assistant Examiner*—Ross Gushi
(74) *Attorney, Agent, or Firm*—Brinks Hofer Gilson & Lione

(57) ABSTRACT

An electrical connector for terminating flat cable of the type having a plurality of signal and ground conductors in parallel alignment comprises a housing which holds a plurality of signal contacts and a ground bus. Each of the signal contacts has a signal conductor termination slot configured for insulation displacement termination of a respective said signal conductor. The ground bus has a plurality of ground conductor termination slots each configured for insulation displacement termination of a respective said ground conductor, and at least one bypass slot configured to permit at least one of said signal conductors to pass through said ground bus without termination thereto. The signal conductor termination slots, the ground conductor termination slots and the at least one bypass slot are arranged such that the plurality of signal and ground conductors reside in a common plane in the connector after termination thereto.

39 Claims, 6 Drawing Sheets

RIBBON CABLE CONNECTOR WITH GROUND BUS

This application is a continuation of application Ser. No. 08/866,505, filed May 30, 1997, now U.S. Pat. No. 6,033, 238.

FIELD OF THE INVENTION

The invention relates to a connector for terminating flat ribbon cable having a plurality of closely-spaced parallel signal and ground conductors.

BACKGROUND OF THE INVENTION

U.S. Pat. No. 4,260,209 discloses an electrical connector for terminating flat ribbon cable of the type having a plurality of signal and ground conductors enclosed in an insulative jacket. The connector has signal contacts with slotted beams for insulation displacement termination of the signal conductors, and a ground bus with slotted beams for insulation displacement termination of the ground conductors. The slotted beams of the signal contacts are disposed at one elevation, and the slotted beams of the ground bus are disposed at a different elevation. Prior to termination, the insulative jacket must be stripped to expose the signal and ground conductors individually so as to permit separation of the signal and ground conductors into different planes. The stripping operation is time consuming and adds to manufacturing cost. Further, after the signal and ground conductors are terminated they reside at different heights in the connector, thereby increasing the overall size of the connector.

U.S. Pat. No. 4,681,382 discloses an electrical connector for terminating flat ribbon cable wherein the signal and ground conductors reside at the same height after termination. However, a portion of the insulative jacket still must be stripped from the signal and ground conductors prior to termination. Also, the unstripped portion of the flat cable is bent back over the connector after termination so that it can be gripped by a strain relief. There is a need for a simpler and more effective connector for terminating flat ribbon cable.

SUMMARY OF THE INVENTION

The invention is an electrical connector for terminating flat cable of the type having a plurality of signal and ground conductors in parallel alignment. The connector comprises a housing which holds a plurality of signal contacts and a ground bus. Each of the signal contacts has a signal conductor termination slot configured for insulation displacement termination of a respective said signal conductor. The ground bus has a plurality of ground conductor termination slots each configured for insulation displacement termination of a respective said ground conductor, and at least one bypass slot configured to permit at least one of said signal conductors to pass through said ground bus without termination thereto. According to the invention, the signal conductor termination slots, the ground conductor termination slots and the at least one bypass slot are arranged such that the plurality of signal and ground conductors reside in a common plane in the connector after termination thereto.

According to another aspect of the invention, the ground bus also has a signal conductor termination slot configured for insulation displacement termination of a respective one of the signal conductors.

BRIEF DESCRIPTION OF THE DRAWINGS

The invention will now be described by way of example with reference to the accompanying drawings wherein.

DETAILED DESCRIPTION OF AN EMBODIMENT OF THE INVENTION

Figure 1:
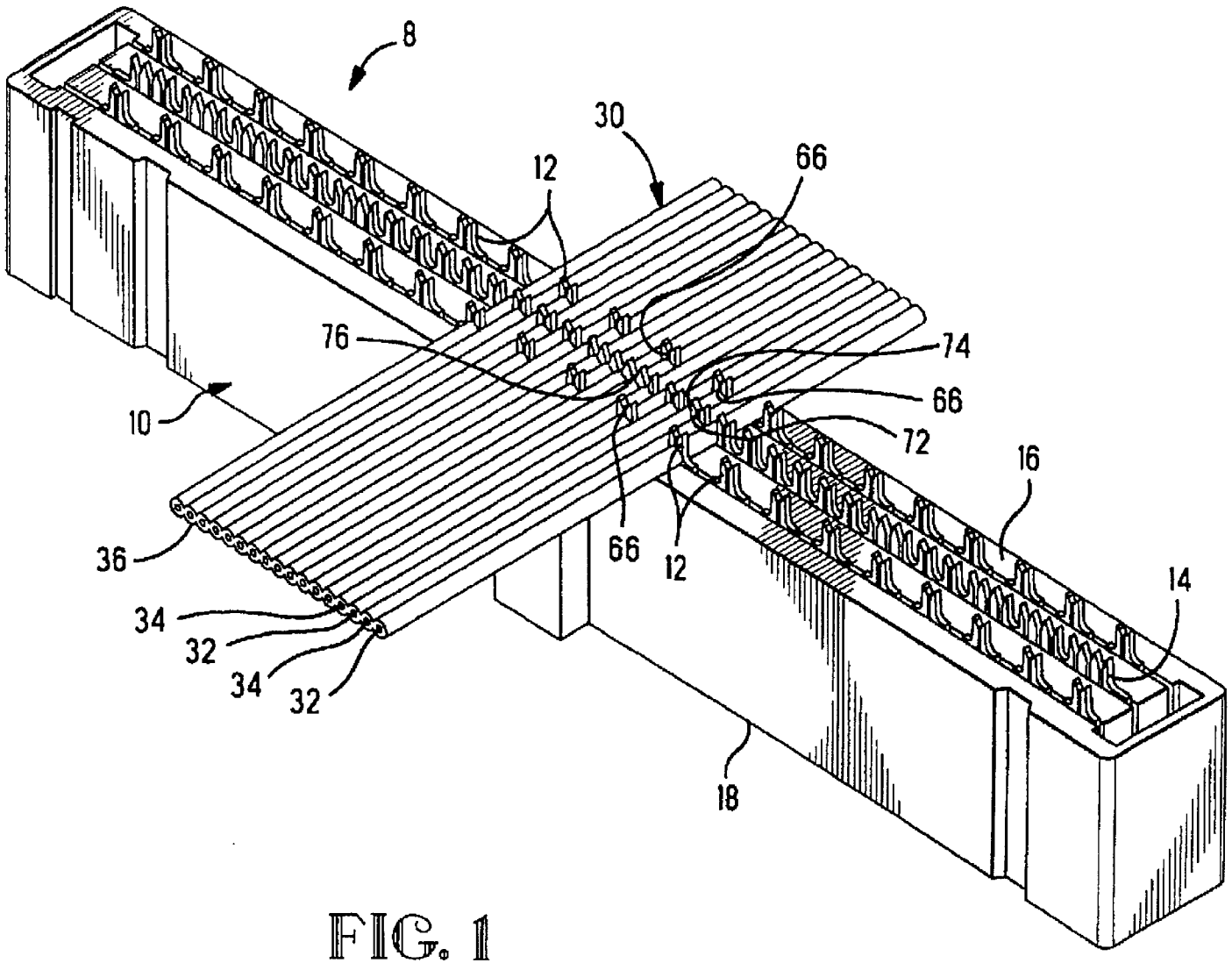
FIG. 1 is an isometric view of an electrical connector according to the invention terminated to a ribbon cable.

There is shown in FIG. 1 an electrical connector 8 comprising an insulative housing 10 which holds a plurality of signal contacts 12 in two longitudinal rows on opposite sides of a ground bus 14. The housing has a terminating face 16 and an opposite mating face 18. The connector 8 is adapted for terminating a flat ribbon cable 30 of the type having a plurality of signal conductors 32 and ground conductors 34 arranged in an alternating sequence in side-by-side parallel alignment within an insulative jacket 36. The cable 30 typically has a sufficient number of signal and ground conductors 32, 34 to extend across the length of the connector 8, although only a portion of the signal and ground conductors of the cable 30 are shown in FIG. 1. The cable 30 is applied to the connector so that the cable extends laterally across the terminating face 16 of the housing 10.

With further reference to FIGS. 2–5, the signal contacts 12 are installed in respective cavities 20 which are open to the terminating face 16 of the housing 10, and the ground bus 14 is installed in a ground bus slot 22 which is also open to the terminating face 16. The cavities 20 for the signal contacts typically extend through the housing so that they are also open to the mating face 18 of the housing. Each of the signal contacts 12 has a retention section 62 that is interference fitted in one of the cavities 20 to retain the signal contact in the cavity. Each of the signal contacts 12 has a termination section 60 which extends above the terminating face 16 of the housing and includes a signal conductor termination slot 66. The slot 66 is bounded by opposed edges which are configured for insulation displacement termination of a respective signal conductor 32 that is inserted into the slot. Each of the signal contacts has a mating section which includes opposed beams 68 that mate with a pin of a mating connector (not shown) when the pin is inserted into the cavity 20 through the mating face 18.

Figure 6:
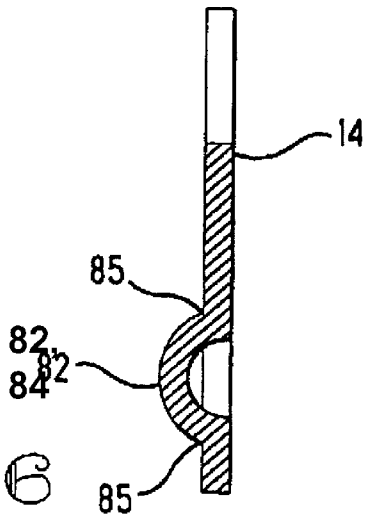
FIG. 6 is a cross-sectional view through a ground bus for the connector taken along line 6—6 of FIG. 3.
Figure 4:
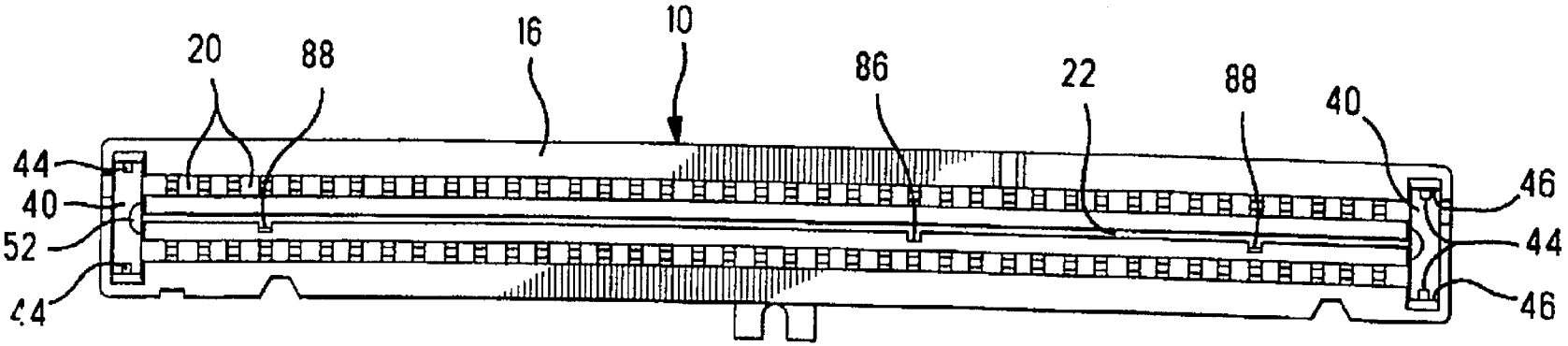
FIG. 4 is a top view of a housing for the connector.
Figure 5:
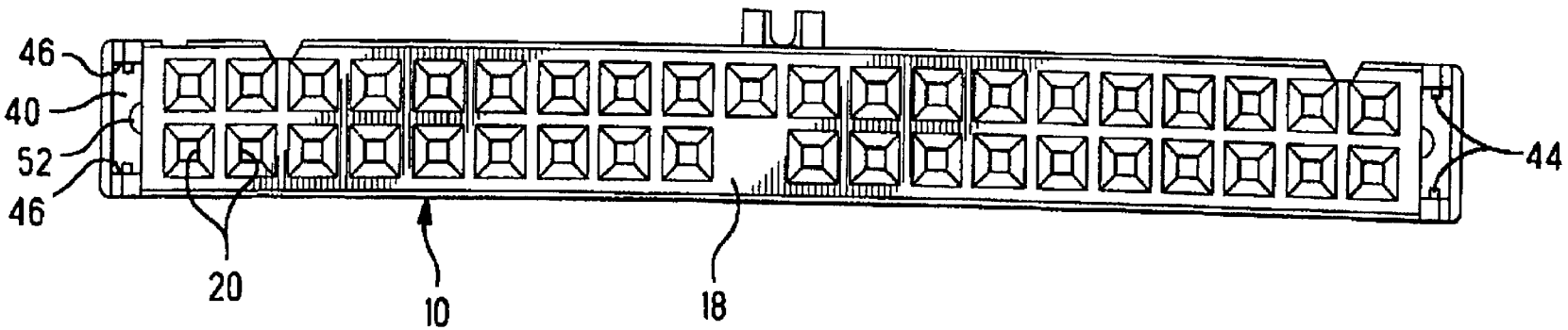
FIG. 5 is a bottom view of the connector housing.
Figure 7:
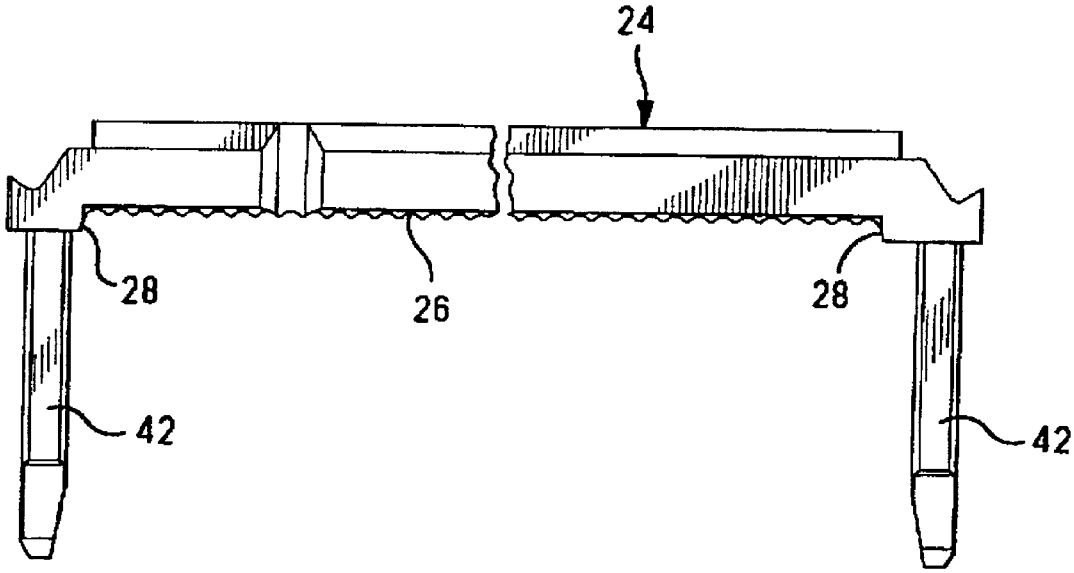
FIG. 7 is a front view of the connector cover.
Figure 8:
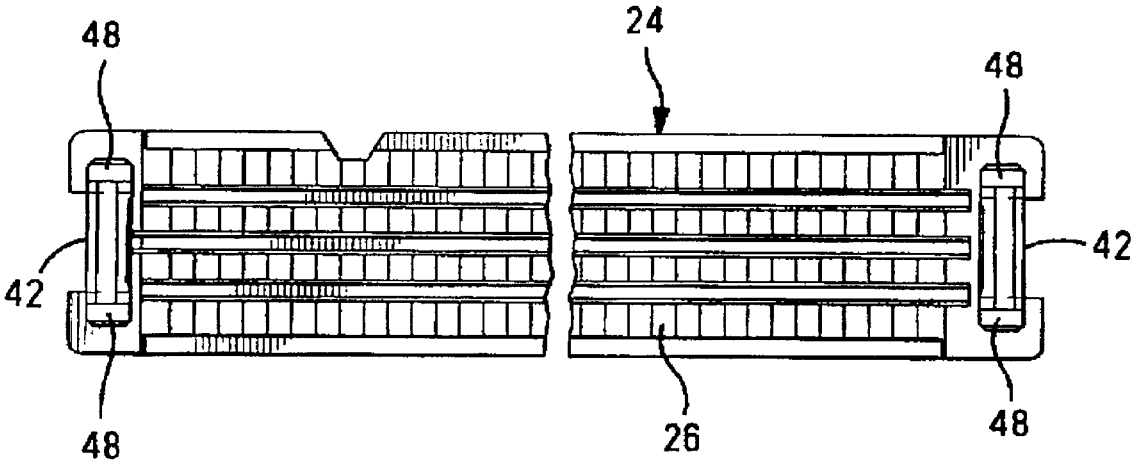
FIG. 8 is a bottom view of the connector cover.
Figure 9:
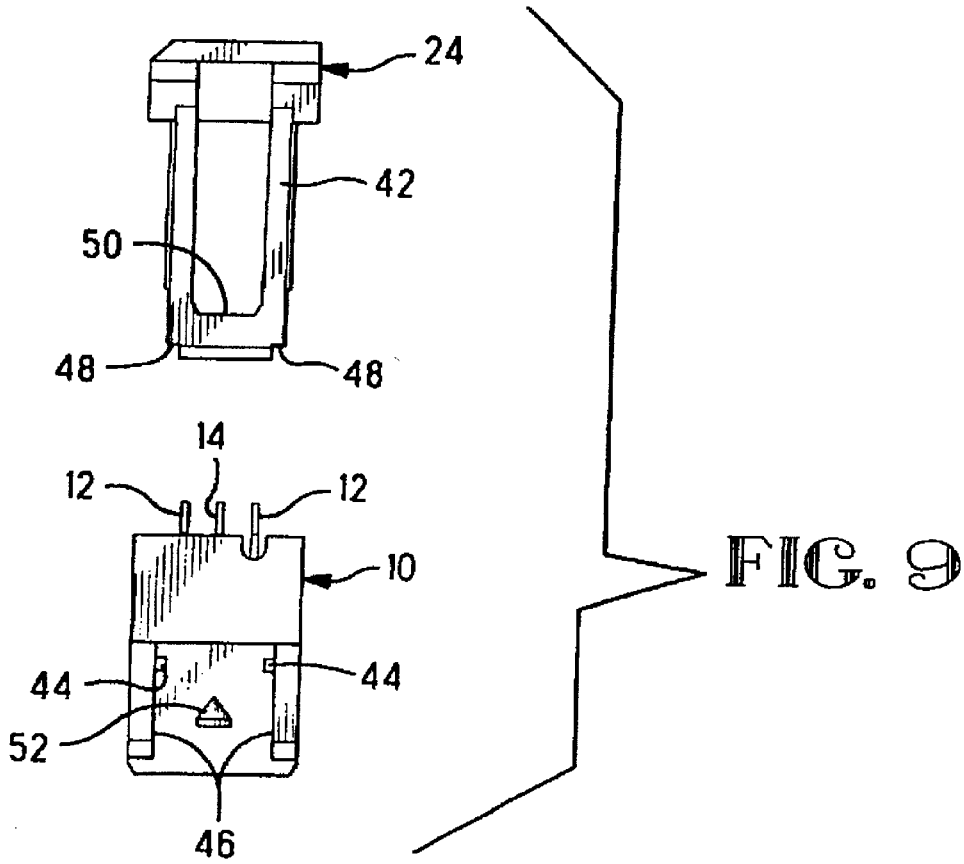
FIG. 9 is side view of the connector with the cover disposed for installation on the connector.

The ground bus 14 is stamped and formed from sheet material and is essentially planar except for three projections including a middle projection 82 and end projections 84 which are deformed out of a plane of the ground bus. As shown in FIG. 6, each of the projections 82, 84 is formed integrally in the ground bus into an arcuate-shaped strip having ends 85 that are attached to the ground bus. The projections 82, 84 are received in corresponding middle recess 86 and end recesses 88 in a side wall of the ground bus slot 22 as shown in FIG. 4. The projections 82, 84 cooperate with the recesses 86, 84 to retain the ground bus in the housing. Further, the middle projection 82 cooperates with the middle recess 86 to serve a keying function as will be explained hereinbelow.

Figure 2:
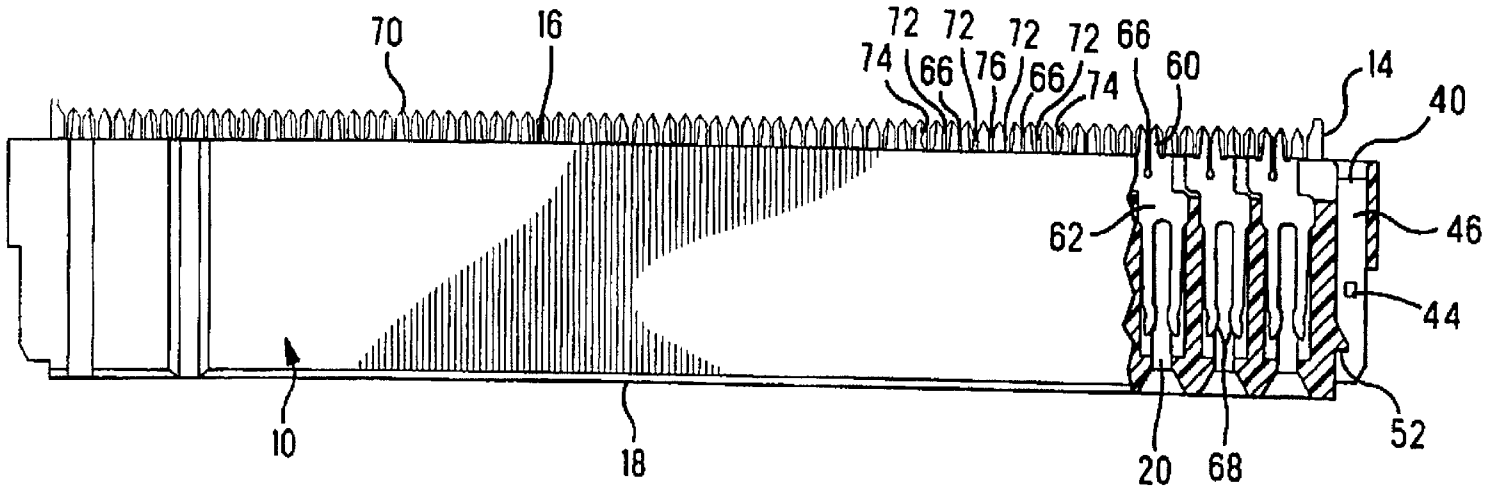
FIG. 2 is a front view of the connector with one end of the connector shown in cross-section.
Figure 3:
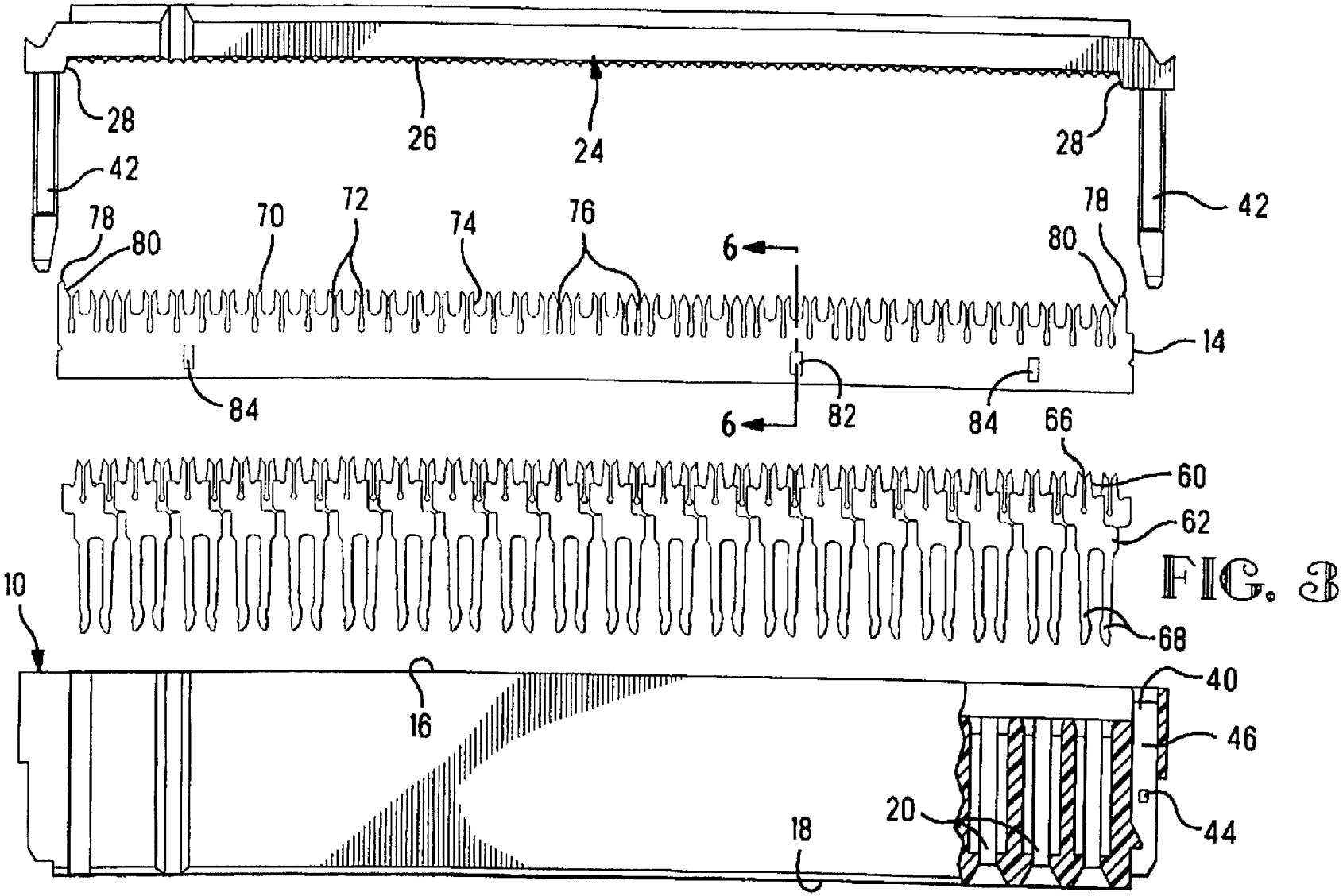
FIG. 3 is an exploded view of the connector shown in FIG. 2, and also showing a cover for the connector.

Referring to FIGS. 1–3, the ground bus 14 has an edge portion 70 which is formed as a termination section that extends above the terminating face 16 of the housing. The edge portion 70 is formed with a plurality of ground conductor termination slots 72 that are configured for insulation displacement termination of respective ones of the ground conductors 34. The edge portion 70 of the ground bus also has bypass slots 74 which are configured larger than the signal conductors 32. Each of the bypass slots 74 is laterally aligned with one of the signal conductor termination slots 66 of an associated signal contact 12. When the cable 30 is terminated to the connector 8 as shown in FIG. 1, the bypass slots 74 receive and accommodate the signal conductors 32 that are terminated in the associated signal contacts 12, thereby allowing the signal conductors to enter the edge portion 70 of the ground bus so as to extend through the ground bus without being terminated to the ground bus. Provision of the bypass slots 74 permits the signal conductor termination slots 66 in the signal contacts and the ground conductor termination slots 72 in the ground bus to be arranged such that the signal and ground conductors 32, 34 of the ribbon cable will all reside in a common plane adjacent to the terminating face 16 of the connector after termination thereto.

The edge portion 70 of the ground bus may also have signal conductor termination slots 76 which are configured for insulation displacement termination of selected ones of the signal conductors 32. Each of the signal conductor termination slots 76 may be provided in place of a corresponding bypass slot 74, thereby providing for selective termination of one of the signal conductors 32 to the ground bus 14. The signal conductor termination slots 76 may be selectively arranged on the ground bus. That is, the ground bus may be produced in different configurations each programmed to common different selected ones of the signal conductors 32 to the ground bus.

The different configurations of the ground bus can be installed in connector housings to provide flat cable electrical connectors which differ only by the programmed selection of the signal conductors to be grounded. In order to differentiate between programmed electrical connectors, the connector housings are color coded. However, there is still a need to prevent inadvertent installation of a ground bus programmed with one configuration into a connector housing that is color-coded for a different configuration. Therefore, the ground bus and the housing have cooperative keying features for each configuration. In particular, the middle projection 82 of the ground bus is located at a different position along the ground bus for each different programmed configuration of the ground bus, and the corresponding color-coded housing has a middle recess 86 in alignment with the projection.

Towers 78 at both ends of the ground bus have surfaces 80 that serve to align the cable 30 in the connector during termination.

With reference to FIGS. 3, 4 and 7–11, the connector 8 receives a cover 24 that is driven toward the housing 10 with the cable 30 therebetween to terminate the cable to the connector 8. The cover 24 has a scalloped surface 26 which accommodates the individual signal and ground conductors 32, 34 of the ribbon cable, thereby providing a nest for the cable. Side surfaces 28 of the nest are contoured to flank the cable closely, thereby helping to align the cable in the nest and in the connector.

Figure 10:
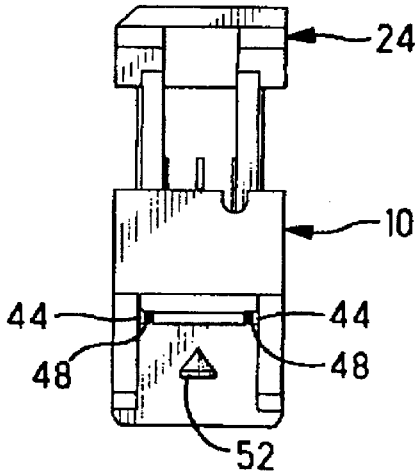
FIG. 10 is a side view of the connector with the cover installed in a pre-stage position.
Figure 11:
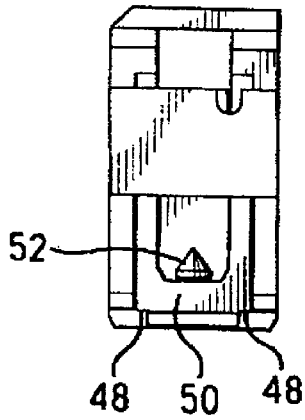
FIG. 11 is a side view of the connector with the cover installed in a fully assembled position.

Each longitudinal end of the housing 10 has a well 40 which receives a latch arm 42 of the cover 24. The housing has bumps or protuberances 44 which extend into each well 40 from side walls 46 thereof. A pair of the protuberances 44 are laterally opposed to each other within each well. The protuberances 44 act as stops which are abutted by shearing surfaces 48 of the latch arms 42 as the latch arms are inserted into the wells, thereby locating the cover at an initial, pre-stage position on the housing as shown in FIG. 10. The latch arms 42 have a slight interference fit between the side walls 46 of the wells, thereby providing a sufficient drag on the latch arms to keep the cover in the pre-stage position. In this position the cable 30 can be threaded between the cover 24 and the housing 10. Upon application of a force that drives the cover and the housing together, the protuberances 44 are sheared from the walls 46 of the well by the surfaces 48 on the latch arms 42. The cover is retained in a final, assembled position on the housing by latch bars 50 on the latch arms 42 which become locked beneath locking tabs 52 on the housing, as shown in FIG. 11.

The invention provides an electrical connector having signal contacts and a ground bus for terminating flat ribbon cable of the type having a plurality of signal and ground conductors arranged side-by-side within an insulative jacket. The invention has the advantages that the insulative jacket need not be stripped from the cable prior to termination, thereby avoiding a stripping operation, and the signal and ground conductors remain in a common plane after termination, thereby permitting the connector to have a small size.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector for attaching to a plurality of insulated conductors, each of said plurality of insulated conductors comprising a conductor and an insulative layer, the connector comprising:

a housing;

a first contact secured in said housing, said first contact defining a slot for receiving a first of said plurality of insulated conductors and making electrical contact with said conductor;

a ground bus secured in said housing, said ground bus comprising a second contact, said second contact defining a slot for receiving a second of said plurality of insulated conductors and making electrical contact with said conductor, said ground bus further comprising a bypass slot, said bypass slot being operative to receive said first of said plurality of insulated conductors without making electrical contact with said conductor;

said housing further comprising a base member having a first surface with first and second openings formed therein, said first opening operative to receive said first contact and said second opening operative to receive said second contact, said first and second openings further operative to retain said first and second contacts in a fixed relationship relative to each other with said slot of said first contact and said slot of said second contact extending outward from said first surface; and wherein said first and second contacts and said bypass slot are arranged such that said first and second of said plurality of insulated conductors lie substantially within the same plane.

2. The electrical connector of claim 1, wherein said first contact is further operative to displace said insulative layer of said first of said plurality of insulated conductors and said second contact is further operative to displace said insulative layer of said second of said plurality of insulated conductors.

3. The electrical connector of claim 1, wherein said ground bus further comprises towers at each end thereof for guiding said plurality of insulative conductors during attachment to the electrical connector.

4. The electrical connector of claim 3, further comprising a cover which can be applied over the plurality of insulative conductors and moved to terminate said insulative conductors to said electrical connector.

5. An electrical connector for attaching to a plurality of insulated conductors, each of said plurality of insulated conductors comprising a conductor and an insulative layer, the connector comprising:

a housing;

a first contact row secured in said housing, said first contact row defining a first slot for receiving a first of said plurality of insulated conductors and making electrical contact with said corresponding conductor;

a second contact row secured in said housing, said second contact row defining a second slot for receiving a second of said plurality of insulated conductors and making electrical contact with said corresponding conductor;

said second contact row further defining a bypass slot for receiving said first of said plurality of insulated conductors without making electrical contact with said corresponding conductor;

said housing further comprising a base member having a first surface with first and second openings formed therein, said first opening operative to receive said first contact and said second opening operative to receive said second contact, said first and second openings further operative to retain said first and second contacts in a fixed relationship relative to each other with said slot of said first contact and said slot of said second contact extending outward from said first surface; and wherein said first and second contacts and said bypass slot are arranged such that said first and second of said plurality of insulated conductors lie substantially within the same plane.

6. The electrical connector of claim 5, wherein said first slot is further operative to displace said insulative layer of said first of said plurality of insulated conductors and said second slot is further operative to displace said insulative layer of said second of said plurality of insulated conductors.

7. The electrical connector of claim 5, wherein said first and second slots, and said bypass slot are open in a common direction.

8. The electrical connector of claim 5, wherein said bypass slot is aligned with said first slot.

9. The electrical connector of claim 5, wherein said second contact row further comprises guide towers for guiding said plurality of insulative conductors during attachment to said electrical connector.

10. The electrical connector of claim 5, further comprising a cover which can be applied over said plurality of insulative conductors and moved to terminate said plurality of insulative conductors to said electrical connector.

11. The electrical connector of claim 5, wherein said second slot is located in a common plane with said second contact row.

12. The electrical connector of claim 5, wherein said bypass slot is aligned with said first slot.

13. The electrical connector of claim 5, wherein said second contact row further comprises projections which cooperate with recesses in said housing to secure said second contact row in said housing.

14. The electrical connector of claim 13, wherein each of said projections includes a strip of material which is deformed out of a plane of said second contact row.

15. The electrical connector of claim 5, wherein said second contact row further comprises third and fourth slots wherein said second, third and fourth slots are adjacent without a bypass slot therebetween.

16. The electrical connector of claim 15, wherein said second, third and fourth slots comprise piercing members, and wherein said adjacent slots share piercing members.

17. An electrical connector for attaching to a plurality of insulated conductors, each of said plurality of insulated conductors comprising a conductor and an insulative layer, the connector comprising:

a housing;

a signal contact row secured in said housing, said signal contact row defining at least one signal slot for receiving a first at least one of said plurality of insulated conductors and making electrical contact with said conductor;

a first ground contact row removably secured in said housing, said first ground contact row defining at least one ground slot for receiving a second at least one of said plurality of insulated conductors and making electrical contact with said conductor, said ground bus further defining at least one bypass slot, said bypass slot being operative to receive said first of said plurality of insulated conductors without making electrical contact with said conductor;

said housing further comprising a base member having a first surface with first and second openings formed therein, said first opening operative to receive said first contact and said second opening operative to receive said second contact, said first and second openings further operative to retain said first and second contacts in a fixed relationship relative to each other with said slot of said first contact and said slot of said second contact extending outward from said first surface; and wherein said at least one signal slot, said at least one ground slot and said at least one bypass slot are arranged such that said first and second at least one of said plurality of insulated conductors lie substantially within the same plane.

18. The electrical connector of claim 17, wherein said at least one ground slot and said at least one bypass slot are characterized by a first arrangement of said at least one ground slot in relation to said at least one bypass slot on said first ground contact row.

19. The electrical connector of claim 18, wherein said first ground contact row may be removed and replaced with a second ground contact row comprising a second arrangement of said at least one ground slot in relation to said at least one bypass slot different from said first arrangement.

20. The electrical connector of claim 18, wherein said housing is keyed to said first ground contact row.

21. An electrical connector for attaching to a plurality of insulated conductors, each of said plurality of insulated conductors comprising a conductor and an insulative layer, the connector comprising:

a housing;

a first contact secured in said housing, said first contact defining a slot for receiving a first of said plurality of insulated conductors and making electrical contact with said first conductor;

a second contact secured in said housing adjacent to said first contact and separated therefrom by a gap, said gap permitting a second of said plurality of insulated conductors to pass therethrough without making electrical contact with said conductor;

a ground bus secured in said housing, said ground bus comprising a third contact, said third contact defining a slot for receiving said second of said plurality of insulated conductors and making electrical contact with said second conductor, said ground bus further comprising a first bypass slot, said first bypass slot being operative to receive said first of said plurality of insulated conductors without making electrical contact with said conductor; and wherein said first, second and third contacts and said first bypass slot are arranged such that said first and second of said plurality of insulated conductors lie substantially within the same plane.

22. The electrical connector of claim 21, wherein said first contact is further operative to displace said insulative layer of said first of said plurality of insulated conductors and said third contact is further operative to displace said insulative layer of said second of said plurality of insulated conductors.

23. The electrical connector of claim 21, wherein said ground bus further comprises towers at each end thereof for guiding said plurality of insulative conductors during attachment to the electrical connector.

24. The electrical connector of claim 23, further comprising a cover which can be applied over the plurality of insulative conductors and moved to terminate said insulative conductors to said electrical connector.

25. An electrical connector for attaching to a plurality of insulated conductors, each of said plurality of insulated conductors comprising a conductor and an insulative layer, the connector comprising:

a housing;

a first contact row having secured in said housing and having a plurality of contacts, said first contact row defining a first slot for receiving a first of said plurality of insulated conductors and making electrical contact with said corresponding conductor;

a second contact row secured in said housing, said second contact row defining a second slot for receiving a second of said plurality of insulated conductors and making electrical contact with said corresponding conductor;

said first contact row further defining a gap between an adjacent two of said plurality of contacts for receiving a third of said plurality of insulated conductors without making electrical contact with said conductor;

said second contact row further defining a bypass slot for receiving said first of said plurality of insulated conductors, said bypass slot being operative to receive said first of said plurality of insulated conductors without making electrical contact with said conductor; and wherein said first and second contacts and said gap and bypass slot are arranged such that said first, second and third of said plurality of insulated conductors lie substantially within the same plane.

26. The electrical connector of claim 25, wherein said first slot is further operative to displace said insulative layer of said first of said plurality of insulated conductors and said second slot is further operative to displace said insulative layer of said second of said plurality of insulated conductors.

27. The electrical connector of claim 25, wherein said first and second slots, and said gap and said bypass slot are open in a common direction.

28. The electrical connector of claim 25, wherein said bypass slot is aligned with said first slot.

29. The electrical connector of claim 25, wherein said second contact row further comprises guide towers for guiding said plurality of insulative conductors during attachment to said electrical connector.

30. The electrical connector of claim 25, further comprising a cover which can be applied over said plurality of insulative conductors and moved to terminate said plurality of insulative conductors to said electrical connector.

31. The electrical connector of claim 25, wherein said second slot is located in a common plane with said second contact row.

32. The electrical connector of claim 25, wherein said second contact row further comprises projections which cooperate with recesses in said housing to secure said second contact row in said housing.

33. The electrical connector of claim 32, wherein each of said projections includes a strip of material which is deformed out of a plane of said second contact row.

34. The electrical connector of claim 25, wherein said second contact row further comprises third and fourth slots wherein said second, third and fourth slots are adjacent without a bypass slot therebetween.

35. The electrical connector of claim 34, wherein said second, third and fourth slots comprise piercing members, and wherein said adjacent slots share piercing members.

36. An electrical connector for attaching to a plurality of insulated conductors, each of said plurality of insulated conductors comprising a conductor and an insulative layer, the connector comprising:

a housing;

a signal contact row secured in said housing, said signal contact row having a plurality of contacts and defining at least one signal slot for receiving a first of said plurality of insulated conductors and making electrical contact with said conductor, said signal contact row further defining at least one gap between adjacent contacts;

a first ground contact row removably secured in said housing, said first ground contact row defining at least one ground slot for receiving a second of said plurality of insulated conductors and making electrical contact with said conductor, said first ground contact row further defining at least one ground bypass slot, said at least one ground bypass slot being operative to receive said first of said plurality of insulated conductors without making electrical contact with said conductor; and wherein said at least one signal slot, said at least one ground slot, said at least one gap and said at least one ground bypass slot are arranged such that said first and second of said plurality of insulated conductors lie substantially within the same plane.

37. The electrical connector of claim 36, wherein said at least one ground slot and said at least one ground bypass slot are characterized by a first arrangement of said at least one ground slot in relation to said at least one ground bypass slot on said first ground contact row.

38. The electrical connector of claim 37, wherein said first ground contact row may be removed and replaced with a second ground contact row comprising a second arrangement of said at least one ground slot in relation to said at least one ground bypass slot different from said first arrangement.

39. The electrical connector of claim 37, wherein said housing is keyed to said first ground contact row.

* * * * *

UNITED STATES PATENT AND TRADEMARK OFFICE

CERTIFICATE OF CORRECTION

PATENT NO. : 6,368,148 B1
DATED : April 9, 2002
INVENTOR(S) : Michael W. Fogg et al.

It is certified that error appears in the above-identified patent and that said Letters Patent is hereby corrected as shown below:

Title page,
Item [75], delete “Harriburg” and substitute -- Harrisburg -- in its place.

Signed and Sealed this

Eleventh Day of February, 2003

JAMES E. ROGAN
*Director of the United States Patent and Trademark Office*